US006342290B1

(12) United States Patent
Conk

(10) Patent No.: US 6,342,290 B1
(45) Date of Patent: Jan. 29, 2002

(54) CAMOUFLAGE PATTERN METHOD AND APPARATUS

(76) Inventor: Nathan T. Conk, 374-16 Kittridge Canyon, Elko, NV (US) 89801

( * ) Notice: Subject to any disclaimer, the term of this patent is extended or adjusted under 35 U.S.C. 154(b) by 0 days.

(21) Appl. No.: 09/436,280

(22) Filed: Nov. 8, 1999

(51) Int. Cl.[7] ..... B44F 7/00

(52) U.S. Cl. ..... 428/195; 428/15; 428/919; 428/17; 2/900

(58) Field of Search ..... 428/919, 195, 428/17, 15, 190; 2/900

(56) References Cited

U.S. PATENT DOCUMENTS 4,576,904 A * 3/1986 Anitole
4,792,471 A 12/1988 Lee ..... 428/17
5,675,838 A 10/1997 Hollinger ..... 2/69
5,695,835 A 12/1997 Weber et al. ..... 428/17
5,727,253 A 3/1998 Wilkinson ..... 2/69
5,753,323 A 5/1998 Anfrus ..... 428/17
5,972,479 A * 10/1999 Lehman

* cited by examiner

*Primary Examiner*—Deborah Jones
*Assistant Examiner*—Wendy Boss
(74) *Attorney, Agent, or Firm*—Pate Pierce & Baird

(57) ABSTRACT

A pattern for camouflage and a method for making the pattern. Rely on photographic images arranged in a synthetic perspective relationship, appearing to extend toward the horizon. The photographic images are images of landscape features in a selected environment. The pattern blends in with landscape features both in proximity to and distant from the camouflage pattern. In one embodiment, the pattern is adapted to be seamlessly repeatable across a surface. In one or two dimensions the method for making the camouflage includes taking photographs and selecting photographic images that represent the landscape features in the selected environment. The method also includes separating those images and arranging them into a repeating pattern. Photographic images are arranged in synthetic perspective which includes obscuring background images with foreground images in a manner that simulates the perspective in the selected environment.

43 Claims, 18 Drawing Sheets

CAMOUFLAGE PATTERN METHOD AND APPARATUS

BACKGROUND

1. The Field of the Invention

This invention relates to a pattern for camouflaging a user and to novel methods for making a pattern for camouflage.

2. The Background Art

Since World War II, a variety of patterns have been designed to camouflage people and objects in an outdoor environment. Military personnel use camouflage clothing for combat and training. Other users of camouflage include hunters, bird watchers, paint ball players and other outdoor recreation enthusiasts. Camouflage prevents people from being detected by other people and animals. A good camouflage can allow hunters and other wildlife watchers to avoid startling wildlife. Camouflage aids the military in performing covert operations and hiding from enemy fire.

Early camouflage was a single color, often a shade of green or brown. More recent camouflage arrangements include repeating geometric shapes with borders. This type of camouflage typically has two or three colors, including green, brown, or black. A green version of this camouflage is designed for hiding a person in a forested environment. Another version of this camouflage is light brown with dark borders around the geometric shapes to match a dry, desert background.

Camouflage clothing manufacturers have recently attempted to create a more realistic appearance by using plant-like three-dimensional additions. However, this camouflage is noisy, cumbersome and may catch on snags. Other camouflage arrangements include artists' renderings or photographic images of wilderness scenes.

Typically, camouflage patterns are effective only in an environment where the user does not stand higher than vegetation. The camouflage schemes currently in use do not provide the illusion of perspective to blend in with a landscape that has low or sparse vegetation. The prior art generally provides camouflage only for a person standing in close proximity to the vegetation. The vegetation must also stand as high as the person for the camouflage to be effective.

In many regions around the world, a camouflage user stands taller than the surrounding vegetation. For example, in the western United States, large regions have only sagebrush and low ground cover. This sagebrush may stand as tall as an individual's knees or waist. Above the sagebrush immediately adjacent to the user, the viewer sees only plants and landscape features behind the user, many of which elements are a considerable distance behind the user. This type of open landscape, where the view is unobstructed by vegetation, is common in arid and semi arid regions, such as southern Europe or the western United States.

Prior art configurations do not camouflage any part of a user above the height of the vegetation because they cannot give the appearance of an open landscape, with vegetation in the distance. The prior art is designed for use only when vegetation reaches the full height of the body of a user. Moreover, no method is available to represent the vegetation or appearance of such landscapes.

In a landscape where a user stands higher than the vegetation or the vegetation is sparse, the camouflage scheme must blend with vegetation some distance behind the user. No currently available camouflage layout recreates an open landscape's view into the horizon.

The prior art is designed primarily for use in forests and not for use in sagebrush, other brush regions, forests or other arid or semi-arid environments. As a result, the currently available camouflage generally does not blend in with the vegetation of arid or semi-arid regions.

Moreover, the more realistic looking camouflage patterns, particularly those that use more realistic images rather than pseudo-random patterns, do not create a repeatable pattern because the images are not adaptable to do so. Some images must be matched to extend across a person's entire body. A repeatable pattern is necessary for commercially feasible large-scale production of camouflage clothing, without telltale discontinuities in the camouflage scheme.

BRIEF SUMMARY AND OBJECTS OF THE INVENTION

In view of the foregoing, it is a primary object of the present invention to provide a pattern that camouflages a user in an environment and blends in with the vegetation in proximity to and at a distance from the camouflage.

It is another object of the present invention to provide a camouflage pattern that blends in with a landscape dominated by comparatively low growing vegetation.

It is another object of the invention to create an image that recreates the appearance of a landscape extending to the horizon.

It is another object of the invention for provide a method for making the pattern.

It is another object of the invention to provide a pattern that combines photographic images into a composite image that blends realistically into the landscape, through the use of synthetic perspective, where the photographic images are selected to reflect the arrangement and density of landscape features in a selected environment.

It is another object of the invention to provide a pattern that can be seamlessly repeated in one or two dimensions, be imprinted on a substrate, be adapted for imprinting on a fabric, or provided in a commercially feasible pattern for mass production on bolts of cloth.

Consistent with the foregoing objects, and in accordance with the invention as embodied and broadly described herein, an apparatus and method are disclosed, in suitable detail to enable one of ordinary skill in the art to make and use the invention.

In certain embodiments an apparatus and method in accordance with the present invention may include taking photographic images of discrete landscape features of a sagebrush environment. In a sagebrush embodiment, photographic images of sagebrush may be the largest of the photographic images used in the pattern. This embodiment may also includes photographic images of small bushes and low groundcover. These photographic images may be selected and isolated from larger photographic images, which include the landscape feature in the natural environment. The isolated photographic images may be arranged in a synthetic perspective relationship. The synthetic perspective relationship is created by overlaying a photographic image on top of any other photographic image that lies above and behind the first photographic image.

Any environment can be recreated by taking photographs of the landscape features in the environment and separating the photographic images of each landscape feature of interest. For example, one embodiment includes photographic images of reeds and rushes arranged in a synthetic perspective relationship, recreating a marsh environment. Another embodiment includes photographic images of aspens, conifers, and herbs, also arranged in a synthetic perspective relationship, recreating an alpine forest environment.

To recreate the appearance of the selected environment, a background color may be selected and can be seen in the spaces between the photographic images of the selected principal element. An accent color may be selected to match the appearance of the environment's background in shadow. The accent color may be smeared across the background color to mottle and shade naturally and randomly.

The repeating pattern is created by the selection and positioning of edge elements and corner elements. Each edge element is selected and split into two halves. The first half is positioned at its opposite edge of the pattern and the other half is position at its opposite edge opposite the first half The edge halves create a single image when two pattern edges are placed together. The pattern contains split edge images positioned at each of the pattern's four edges. The corner elements are split into four quadrants. Each quadrant is positioned at its opposite corner of the pattern, creating a complete image when the pattern is repeated in two dimensions.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

FIG. 20 is an illustration of a single color plate; and

FIG. 21 is an illustration of single color plate.

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 1 through 21, is not intended to limit the scope of the invention. The scope of the invention is as broad as claimed herein. The illustrations are merely representative of certain, presently preferred embodiments of the invention. Those presently preferred embodiments of the invention will be best understood by reference to the drawings, wherein like parts are designated by like numerals throughout.

Those of ordinary skill in the art will, of course, appreciate that various modifications to the details of the Figures may easily be made without departing from the essential characteristics of the invention. Thus, the following description of the Figures is intended only by way of example, and simply illustrates certain presently preferred embodiments consistent with the invention as claimed.

Figure 1:
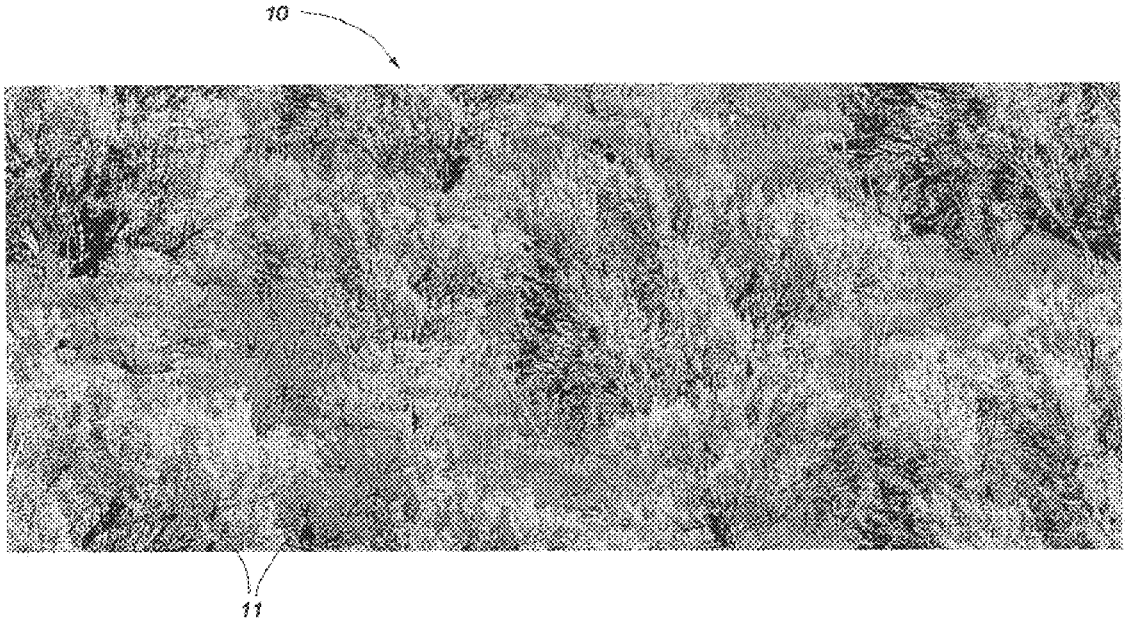
FIG. 1 is an illustration of a pattern of one preferred embodiment of synthetic perspective camouflage.

FIG. 1 shows a pattern 10 of one preferred embodiment in grayscale. The illustrated pattern 10 is composed of twelve different colors (represented by shades of gray) selected to match a selected environment. The pattern has an ecotone motif, meaning the landscape features used in a pattern are selected from landscape features that occur naturally together. The pattern 10 may contain any number of colors selected to match the selected environment. The colors of the pattern 10 may also reflect a selected time of day. The illustrated pattern is particularly suited to camouflage for open landscapes during daylight.

The environment of the illustrated embodiment is a western United States region with a sagebrush landscape. The selected environment may be any environment in which users desire camouflage. Users include hunters, bird watchers, and other outdoor recreation enthusiasts. Military personnel may also use camouflage for training and combat.

The pattern may be printed on a substrate. The substrate may be any surface, such as a fabric-like material, for example, where the presentation surface is the same as the area of the substrate.

The pattern 10 includes photographic images 11 of discrete landscape features. The photographic images 11 of the illustrated pattern may include images of shrubs, bushes, grasses and the like. Alternative embodiments may contain any combination of shrubs, bushes, grasses, rocks, herbs, trees, flowers, rocks, deadwood, and the like to match the pattern 10 to the selected environment. For example, the pattern 10 may include photographic images of scrub oak and grass to match a western United States foothill environment. Alternatively, the pattern may include a combination of photographic images including: Joshua trees, desert shrubs and small cacti to match a desert environment; reeds and rushes to match a marsh environment; or conifer, aspens, and herbs to match an alpine terrain or even tundra.

Figure 2:
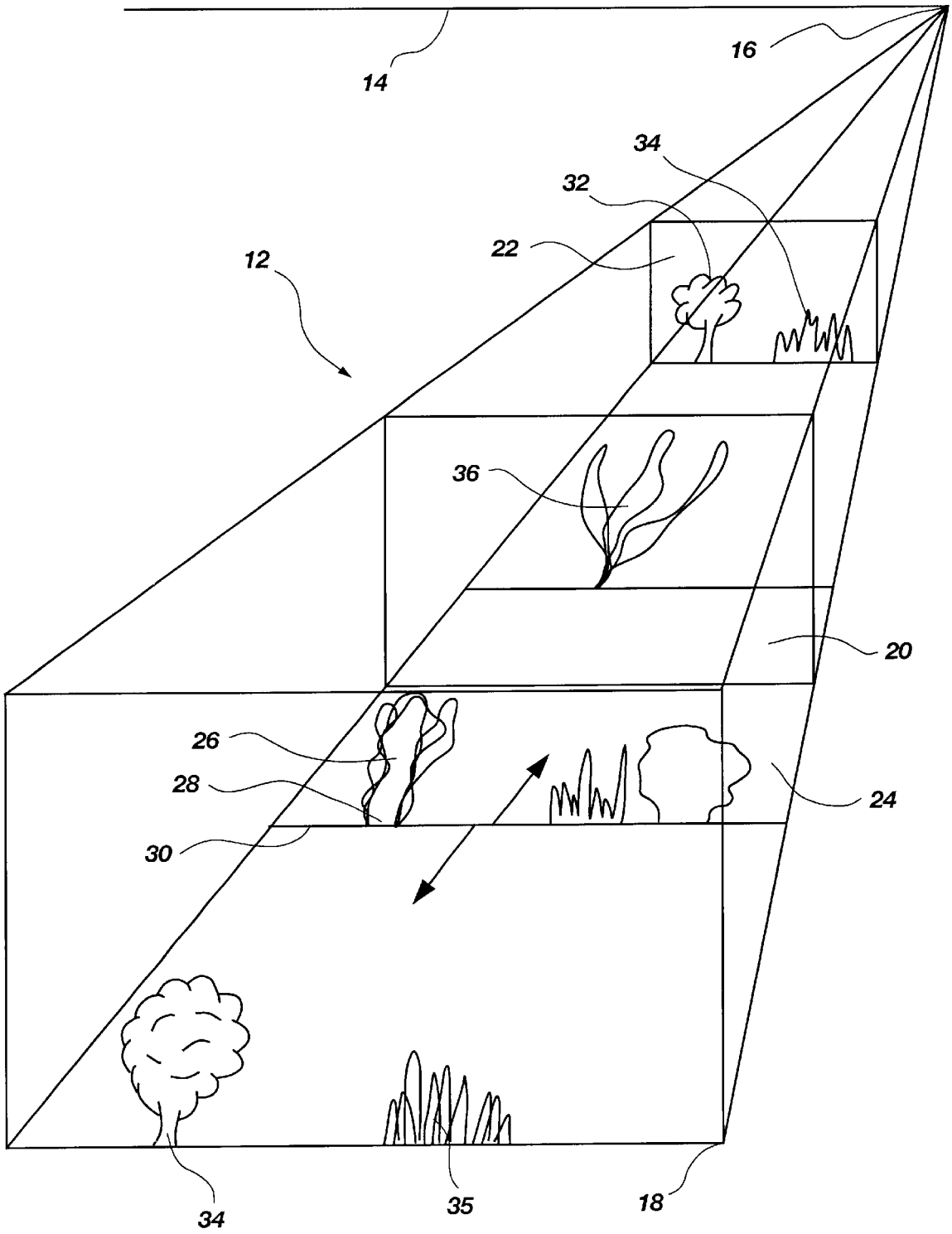
FIG. 2 is a perspective view of a diorama illustration of the pattern organization.

FIG. 2, a perspective view of a three dimensional diorama illustration 12 of the pattern 10, shows the synthetic perspective relationship and organization of photographic images 11 in the pattern 10. The perspective illustration 12 has a horizon 14 that is imaginary and above the pattern 10. The perspective illustration 12 shows a vanishing point 16 in the horizon 14, an imaginary point at which the pattern 10 would disappear in horizon 14, if the pattern 10 extended indefinitely. The perspective illustration 12 has viewing planes, 18, 20, 22 and a reference plane 24. A reference image 26 lies in the reference plane 24 and has a base 28. A reference line 30 runs through the base 28 of the reference image 26.

The perspective illustration 12 also shows several photographic images 11, including three that are background images 32, 34, and 36, lying in viewing planes 20 and 22. Any portions of the background images 28, 30, or 32 that appear to be directly behind the reference image 26 are obscured by the reference image 26.

The perspective illustration 12 also has photographic images 11 that are foreground images 34, 35 in a viewing plane 18. Foreground images 34, 36 will mask any portion of the reference image 26 that appears to be directly behind foreground images 34, 36. The base 28 of the reference image 26 is obscured by an upper portion of a foreground image 38, adding to the synthetic perspective in the pattern 10.

The perspective illustration 12 shows that the perspective of the pattern 10 may run toward the vanishing point 16. This perspective creates a perception in the viewer, an animal or another person, that the object represented by foreground images are smaller that the objects represented by the background images, even if the two images are actually the same size.

Figure 3:
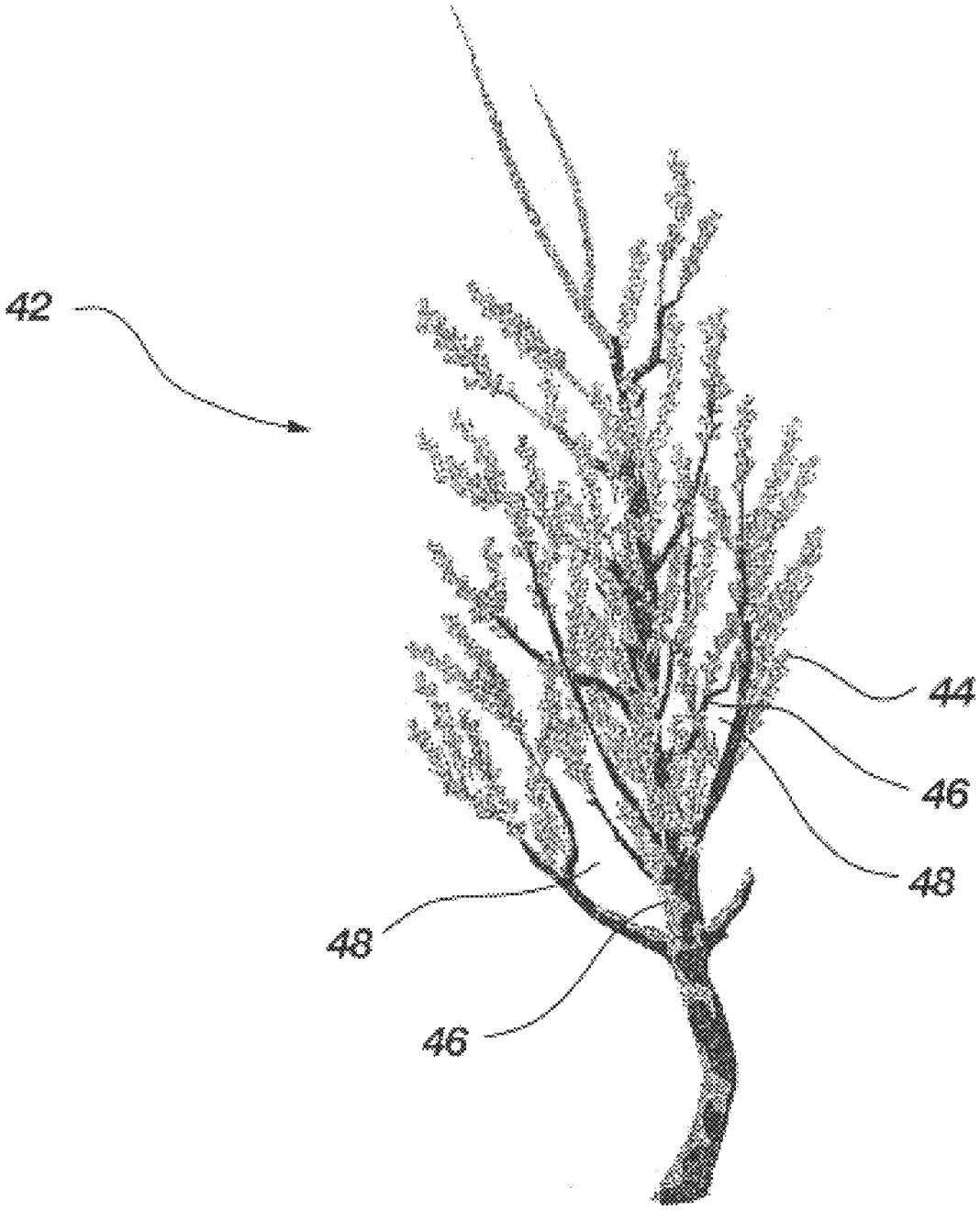
FIG. 3 is a line drawing representing a photographic image of a large element.

FIG. 3 shows a computer representation (e.g. line drawing) of a large pattern element 42. Large element 42 is a photographic image that has been isolated from a larger photographic image (not shown) of large element 42 and the surrounding vegetation or landscape. A large element is a photographic image 11 of a landscape feature that is large relative to all the landscape features in the environment.

The complete photographic image (not shown) of a selected environment is selected to represent part of an ecotone of the environment. Large elements 42 combined in a single pattern 10 are usually from the same ecotone. The term ecotone describes a given group of plant types that occur naturally together, such as aspen/conifer or sage/juniper. The environment is a given landscape, in which hunters need camouflage. For example, the environment may be a landscape in the western United States, where the ecotone selected may be sagebrush and grass.

Large element 42 is separated from a larger photographic image along both its exterior boundaries 44 and its interior boundaries 46. The interior boundaries 46 create interior spaces 48 within large element 42.

Figure 4:
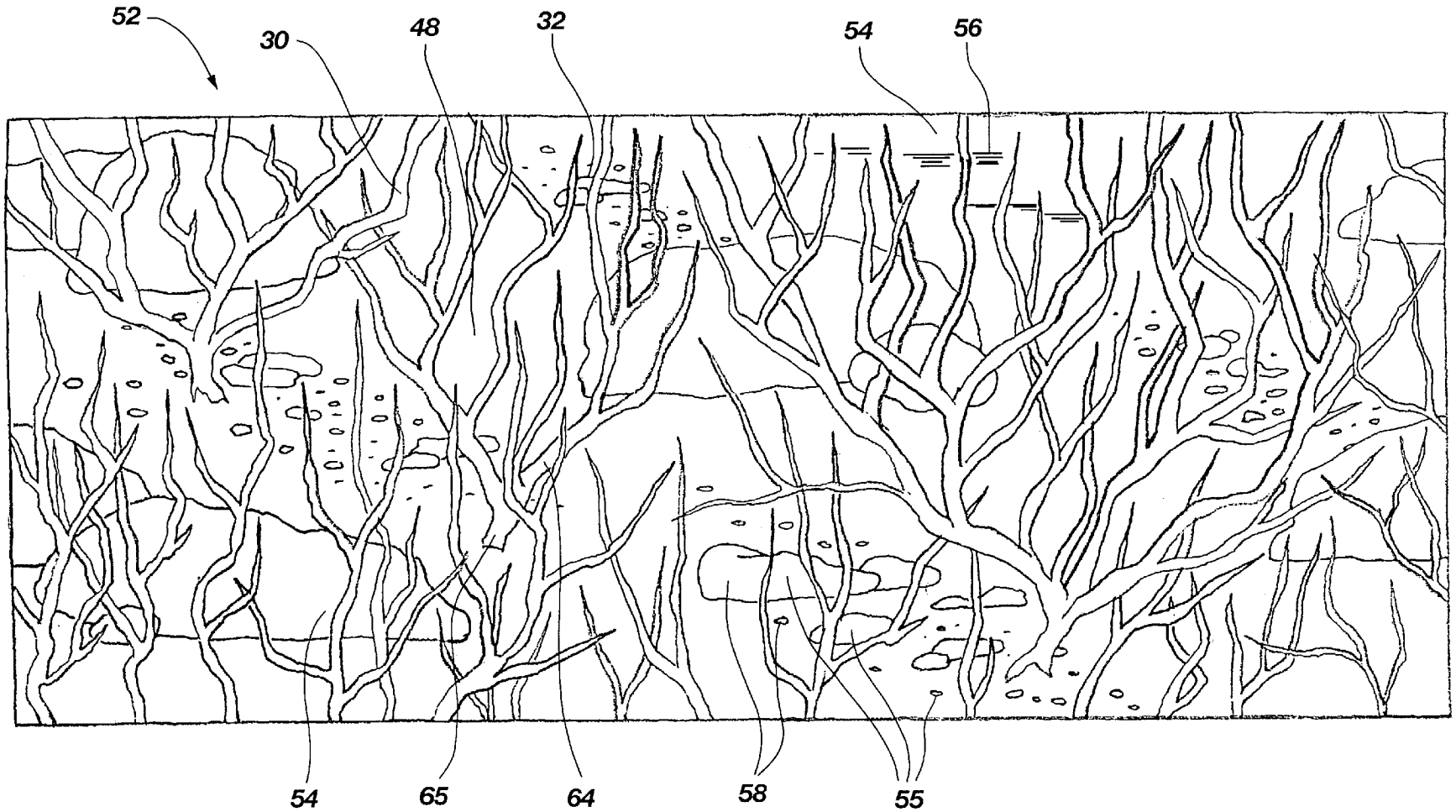
FIG. 4 is a line drawing representing the organization of photographic images in a pattern.

FIG. 4 shows a simplified line drawing 52 representing the organization and synthetic perspective of photographic images 11 in a pattern 10. The line drawing has a first layer of a background 54 and an accent color 56. The background 54 is a color selected to match a dominant ground color or background foliage color of the selected environment. For example, the background 54 could be rusty colored to match the red soil of the southwestern United States. Alternatively, the background 54 could be a light brown to match the sandy soils of desert regions. The background 54 could also be black with a light accent color to match a wet, marshy environment.

Accent color 56 is selected to be a secondary color of the selected environment. The accent color may be the color the ground in shadow. Alternatively, the accent color may be a secondary color of the soil or undergrowth. Accent color 56 is smeared across background 54, giving a textured and shadowed appearance to background 54.

As shown in FIG. 4, the next layer of the pattern 10 contains groundcover 58. In this representation of the pattern 10, the groundcover 58 is made up of images of small and large rocks 55. The groundcover 58 could be any number of distinct images, selected to match the desired environment. For example, one camouflage pattern could contain a groundcover 58 of low growing clumps of grass. An alternative pattern 10 could have a groundcover 58 of small bushes. Any mixture of images of rocks, herbs, grasses, and/or small bushes could be used to recreate the appearance of the selected environment.

The layer on top of the groundcover 58 contains several large elements 42. One of the large elements 42 of FIG. 4 is a reference image 64. The interior spaces 48 of the reference image 64 reveal groundcover 58 and background images 30, 32 that lie directly behind the reference image 24.

Where the reference image 64 overlaps another photographic images and has a base 65 that lies below the other photographic image, the reference image 64 obscures the overlapping portions of photographic image. Any large element 42, groundcover 58 or other photographic images 11, that lie below the reference image 64 and interfere with a part of the reference image 64, mask the overlapping part of the reference image 64.

Figure 5:
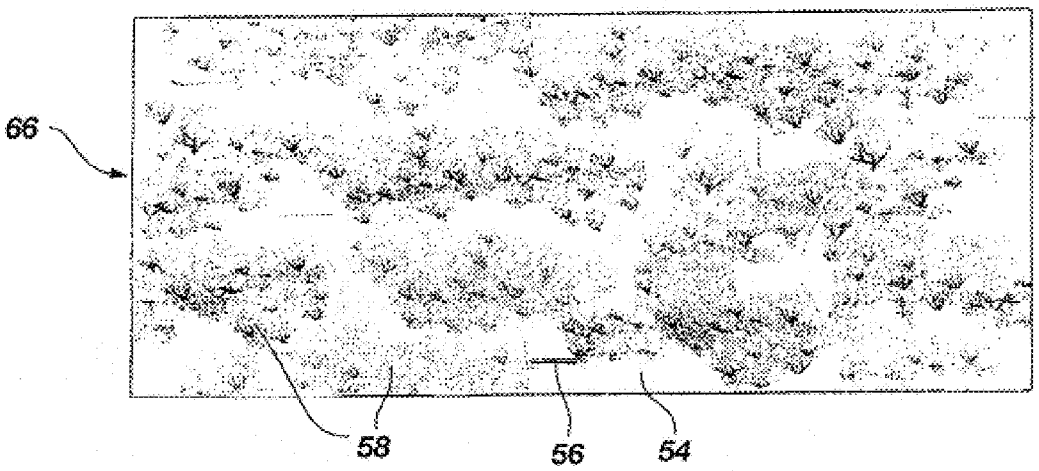
FIG. 5 is an illustration of a groundcover layer of a pattern.
Figure 6:
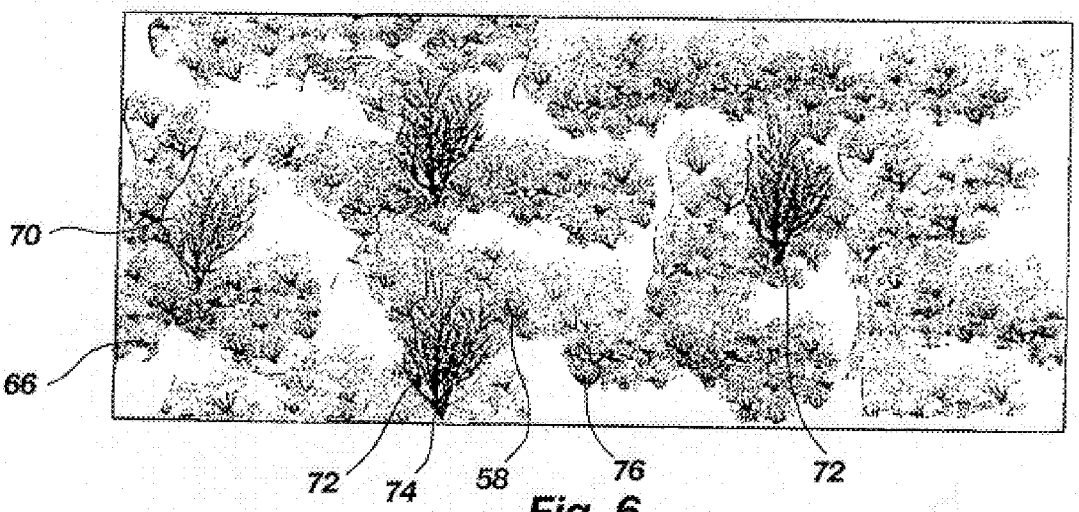
FIG. 6 is an illustration of a mid size element layer suitable for super position over a groundcover layer.
Figure 7:
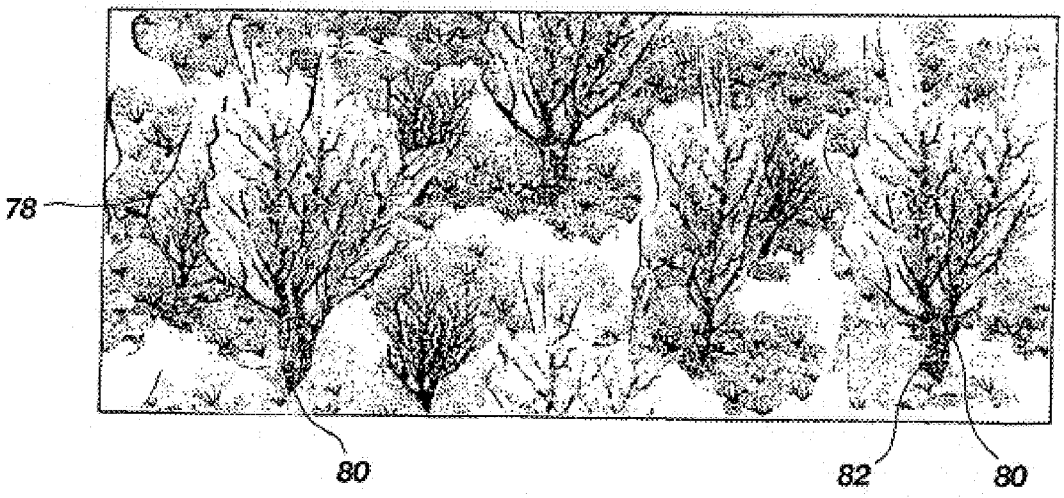
FIG. 7 is an illustration of a large element layer suitable for super position over groundcover and mid size element layers.

FIGS. 5–7 show the organization and synthetic perspective of a pattern 10. FIG. 5 shows a groundcover layer 66 with substantially evenly spaced groundcover 58. The groundcover 58 of this embodiment is made of photographic images of low growing shrubs. However, groundcover 58 could be made up of discrete images of low grass clumps, rocks, or low shrubs, or any combination of the same. Background 54 and accent color 56 are visible around the groundcover 58.

FIG. 6 shows a mid-size element layer 70 on top of a groundcover layer 66. Mid-size element layer 70 is composed of mid-sized elements 72, which are images of small bushes in this illustration. The mid-sized elements 72 could be photographic images of rock, groups of herbs, small trees, bushes or other plants. The mid-size elements 72 are mid-size relative to other elements in the pattern 10 and represent mid-size landscape features, that are mid size relative to the features in the landscape.

The mid-size elements 72 obscure portions of groundcover 58 with bases 76 that appear to lie above and behind the base 74 of each mid-size element 72. Groundcover 58 obscures a mid-size element where the base 76 of groundcover 58 lies below a mid-size element 72 in the pattern 10 and overlaps mid-size element 72. The bases 74 of mid-sized elements 72 are generally obscured by groundcover 58. Exposed bases of mid-size elements 72 are obscured by overlapping groundcover 58 with a base 76 positioned below the base 72 of the mid-size element, adding to the synthetic perspective.

FIG. 7 shows a pattern 10 with a large element layer 78 over a groundcover layer 66 and a mid-size element layer 70. Large element layer 78 has large elements 80, which are images of large bushes in the illustrated embodiment. Large elements 80 are photographic images of landscape features that dominate the landscape and are large relative to other landscape features. The large elements 80 could be a number of images, including trees, deadwood, large rock, or cactus, in any combination required to match the appearance of the selected environment.

The organization of the large element layer 78 is similar to the organization for the mid-size layer 70. The large elements 80 are spaced farther apart than the groundcover 58. The large elements 80 partially obscure all other images directly above and behind, except for portions of other images that show through the interior spaces 48 of the large elements 80. All images with a base 74, 76 below a base 82 of a large element 80 obscure the overlapping portion of the large element 80. The bases 82 of large elements 80 are obscured by overlapping groundcover 58 or mid-size elements 72 with bases 74, 76 that lie below the base 82 of the large elements 80.

Figure 8A:
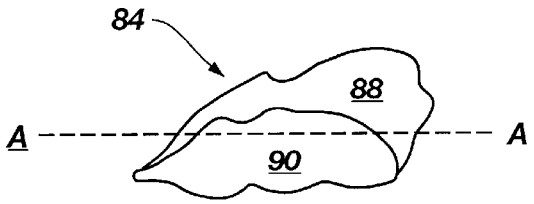
FIG. 8A an illustration of an edge element.
Figure 8B:
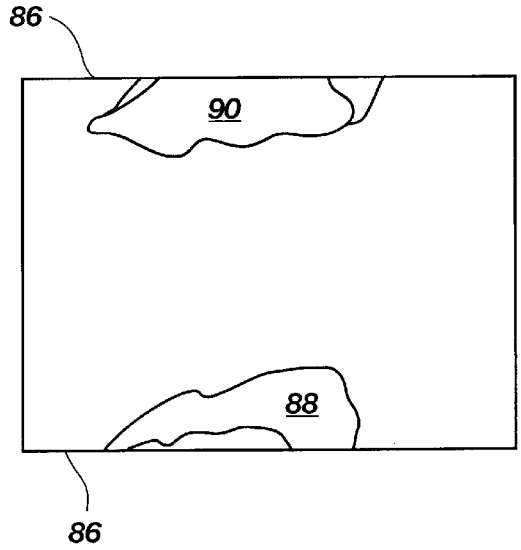
FIG. 8B is an illustration showing the position of an edge element in a pattern.

FIGS. 8A and 8B show the organization of edges 85, 86 of the pattern 10. An edge element 84 has two halves 88, 90. One half 88 of the edge element 84 is positioned with dividing line A—A aligned with an edge 85 of the pattern 10.

The other half 90 of edge element 84 is positioned on the opposite edge 85. The positioning of halves 88,90 create a pattern capable of repeating along edges 84, 85.

Figure 9A:
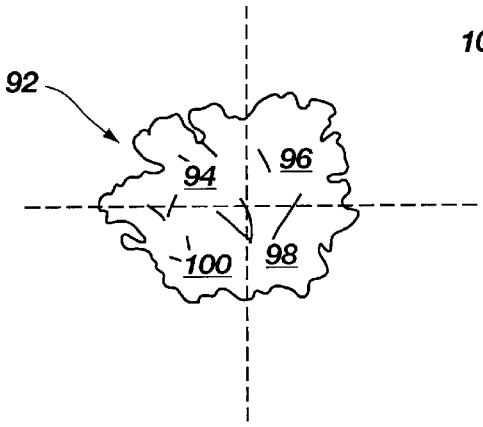
FIG. 9A an illustration of a corner element.

FIGS. 9A and B show the position of a corner element 92. The corner element 92 in the illustrated embodiment, is a large element 80, although a mid-size element 72, groundcover 58, or background 30 could also be corner elements.

Corner element 92 has four quadrants, 94, 96, 98 100. Each quadrant is positioned in one of four corners 102, 104, 106, 108 of the pattern 10. The four quadrants 84, 96, 98, 100 create a pattern 10 that is continuous at corners 102, 104, 106, 108 of the pattern 10 when the pattern 10 is repeated in all directions.

Figure 10:
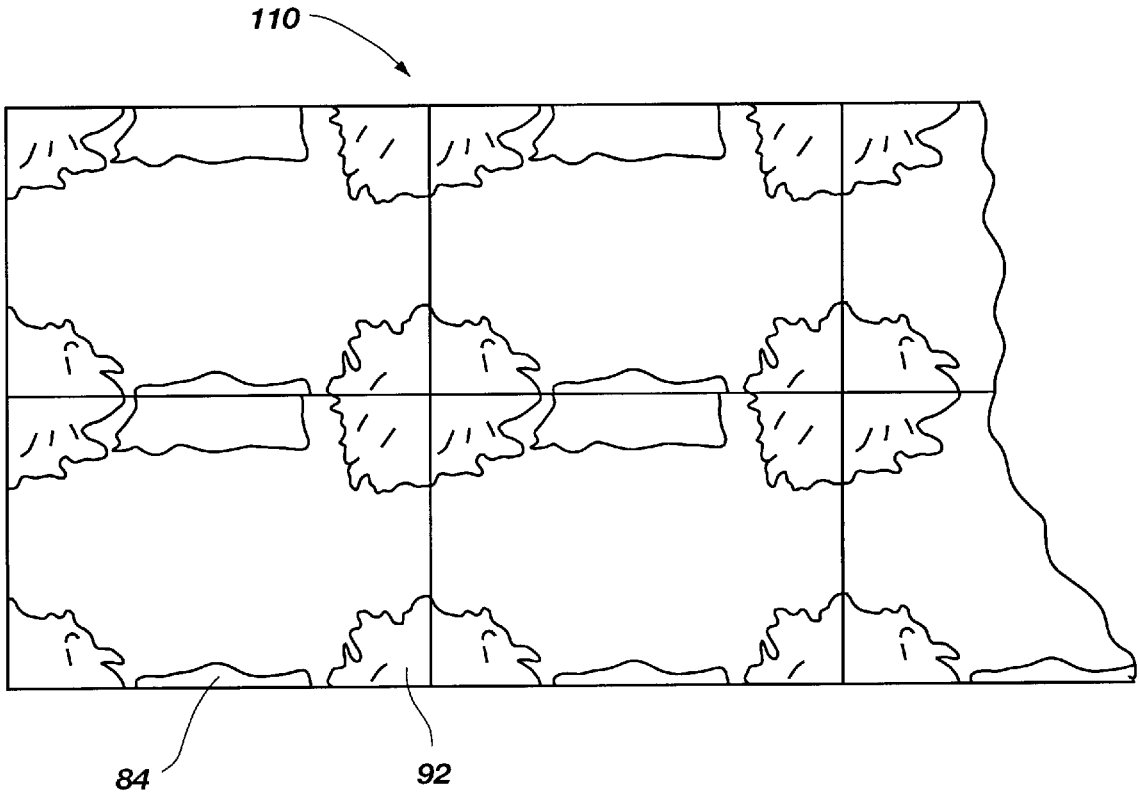
FIG. 10 is an illustration of a pattern repeated.

FIG. 10 shows a repeating pattern 110 created by several patterns 10. The repeating pattern shows the position of corner element 92 and edge element 86, which create a seamless, repeatable pattern 110.

The pattern 10 may be printed on a surface of a substrate. The pattern 10 may also be seamlessly repeated in one or two dimensions. The substrate may be a fabric or another material that is fabric-like, being relatively flexible in the transverse direction and relatively inflexible orthogonally. The substrate may be adapted to print on cloth or fabric.

Figure 11:
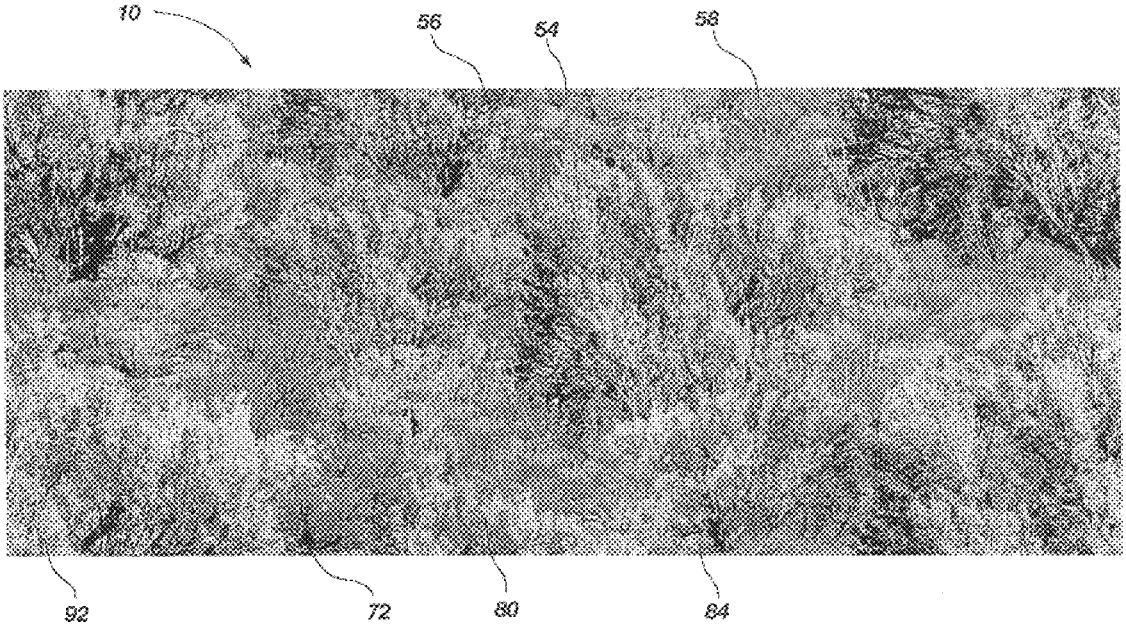
FIG. 11 is an illustration of a sample of a pattern in accordance with the invention

FIG. 11 shows, for discussion purposes, a pattern consisting of a background 54 with an accent color 56, groundcover 58, mid size elements 72, large elements 80, edge elements 84 and a comer element 92.

Figure 12:
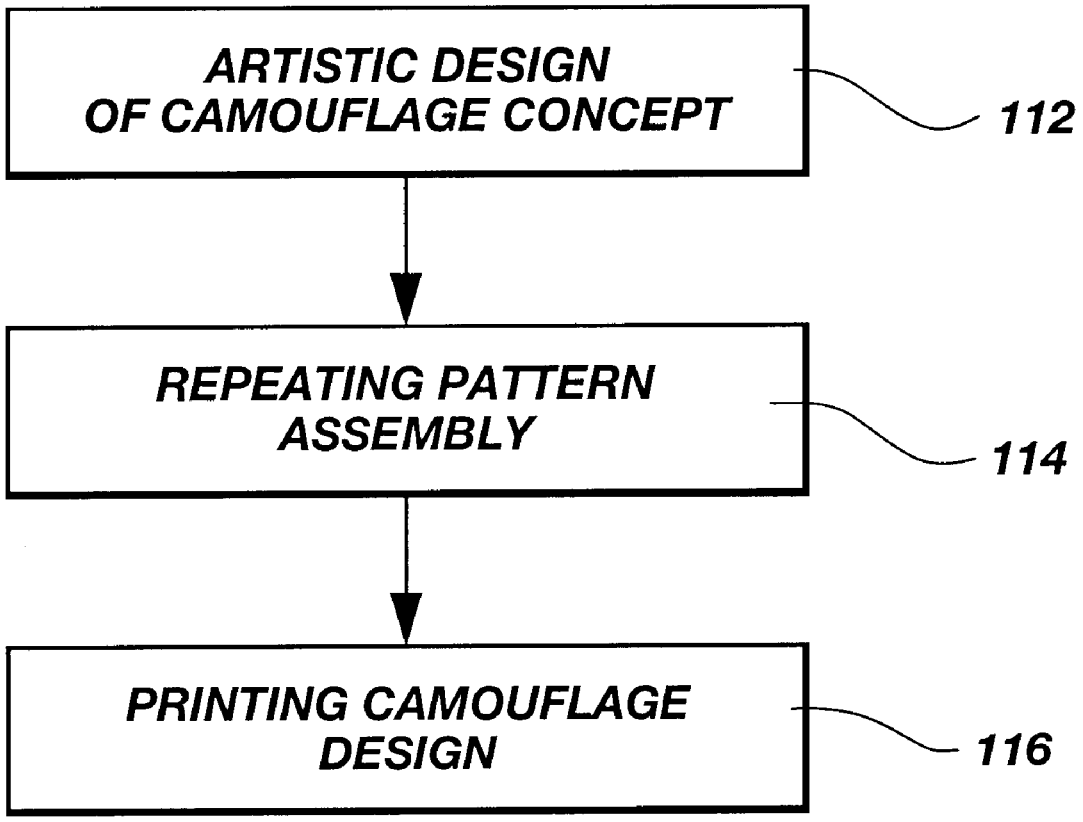
FIG. 12 is an overview flowchart of a method of creating a pattern in accordance with the invention.

The pattern is arranged in accordance with the principles of the method shown in FIG. 12, a flowchart overview of the method. The method is divided into three parts, the artistic design of the camouflage 112, pattern assembly 114, and printing the pattern 116.

Figure 13:
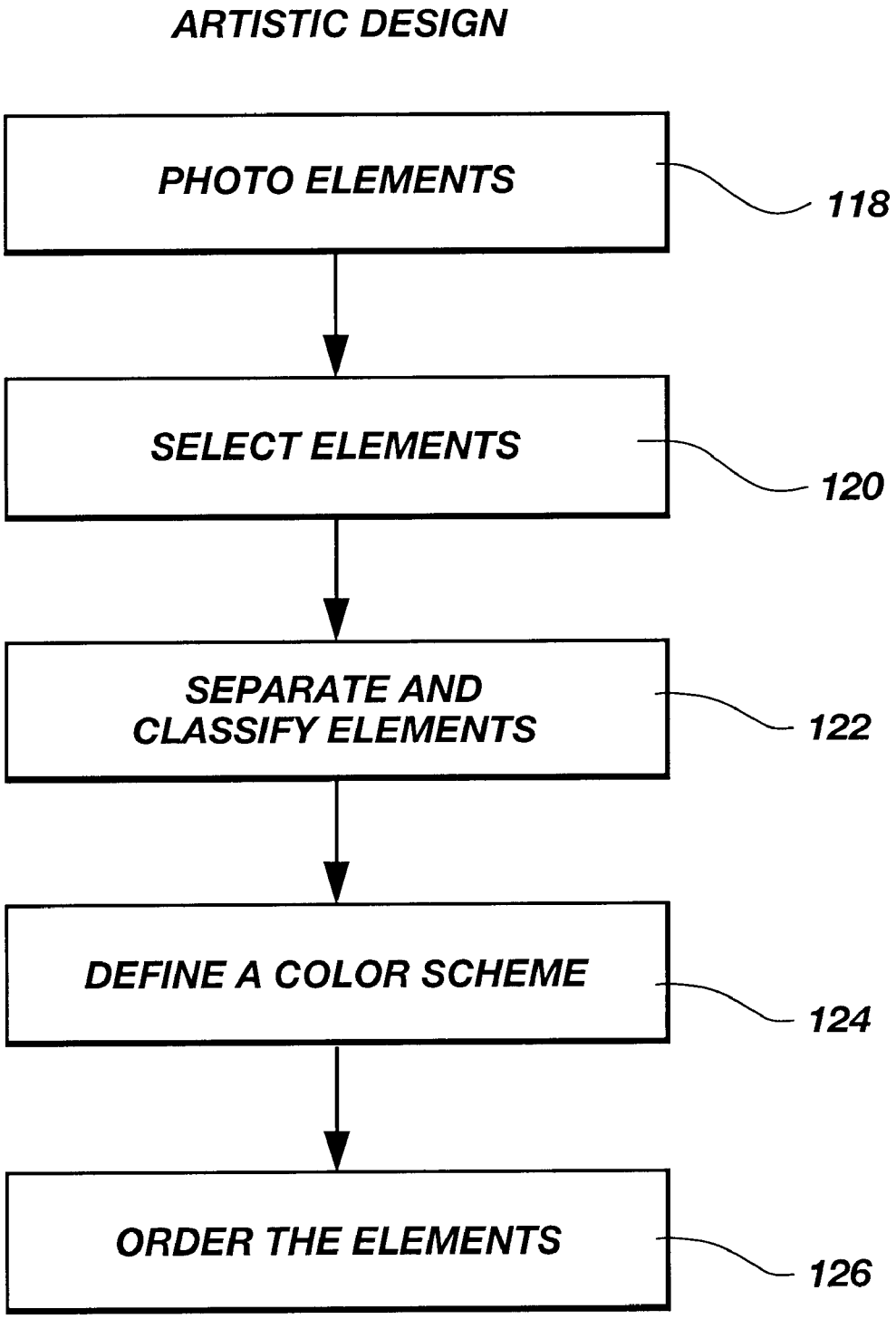
FIG. 13 is a flowchart of a method for artistic design of a pattern in accordance with the invention.
Figure 14:
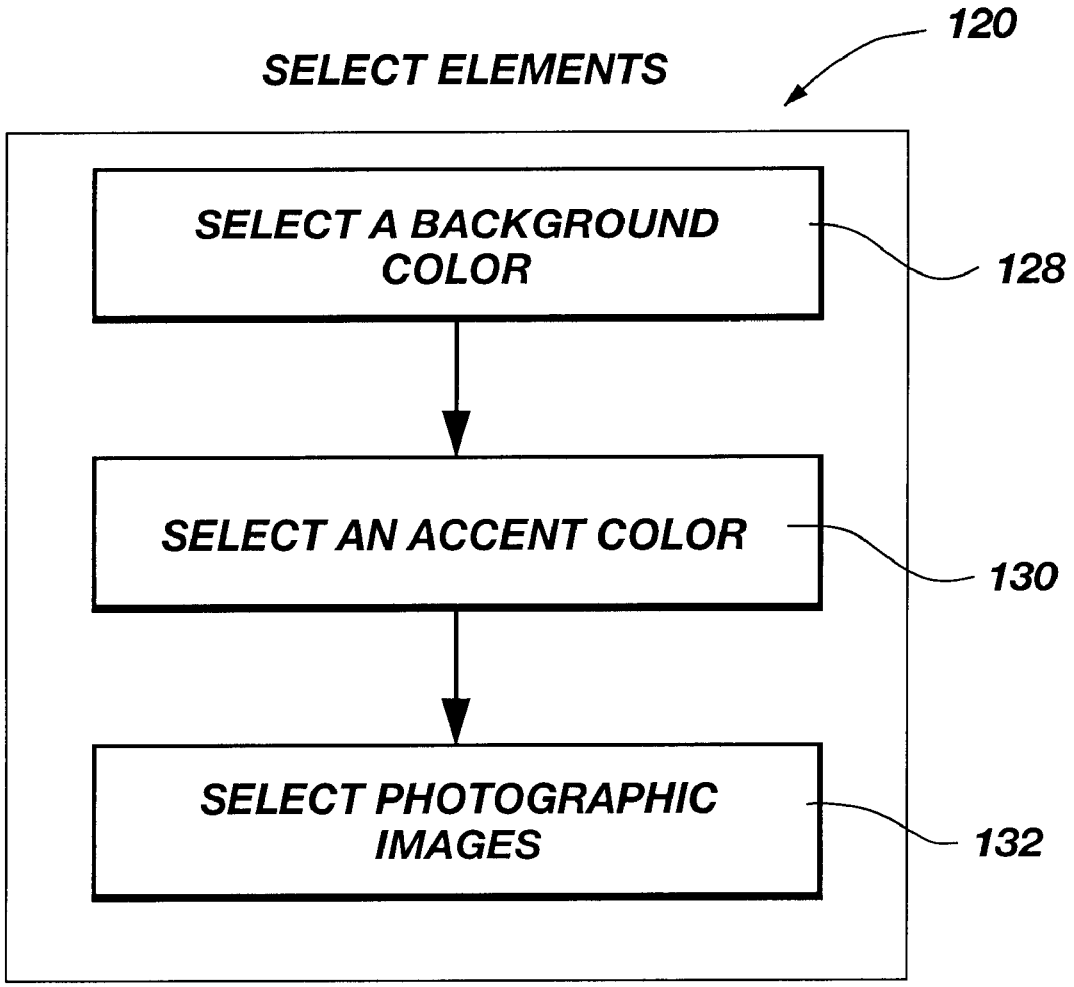
FIG. 14 is a flowchart of a method for element selection of a pattern in accordance with the invention.

FIG. 13 is flowchart showing each step of the artistic design of the camouflage 112. The steps are: photographing elements 118, selecting elements 120, separating and classifying elements 122, defining a color scheme 124, and ordering the elements 126.

The first step in artistic design of the camouflage 112 is photographing elements 118 in the selected environment. Each photograph should include at least one entire landscape feature that represents a part of the ecotone of the selected environment. The term ecotone describes a given group of plant types that occur naturally together, such as aspen/conifer or sage/juniper. A landscape feature is any plant, rock, or any other stationary part of the selected environment.

For the pattern of FIG. 11, landscape features are photographed as close-ups and at a distance. Where the selected environment has mainly low landscape features relative to the user, the viewer of the pattern can see landscape features farther off than a viewer can see in an environment with tall features relative to the use. Therefore, where the selected environment has mainly low landscape features, both close up and distance phonographs should be taken. Alternatively, where the selected environment has mainly tall landscape features relative to the user, mainly close up photographs should be taken.

Several photographs are taken in the selected environment under selected conditions to obtain all the desired landscape features in the desired level of daylight. The photographs may be scanned into a computer for easy manipulation with a computer graphics program.

The next step in the artistic design 112 of the pattern 10 is selecting elements 120. Selecting elements 120 includes the following steps: selecting background 128, selecting an accent color 130, selecting photographic images 134. Selecting background 128 includes reviewing all photographs of the selected environment and finding a color to represent the most dominant ground color or undergrowth color of the selected environment. The background may match the dirt color or may match the color of a ubiquitous plant.

Selecting accent color 130 also requires reviewing photographs of the selected environment. The step includes reviewing the photographs and selecting a secondary color of the soil or undergrowth. Alternatively this steps includes selecting a dominant color of the ground or undergrowth in shadow.

The step of selecting photographic images 132 includes reviewing photographs and selecting landscape features to represent the ecotone of the selected environment. An ecotone is a term describing the types of plants that occur naturally together. The photographic images 11 should be selected to represent the distinct colors and sizes present in the landscape features of the selected environment.

Figure 15:
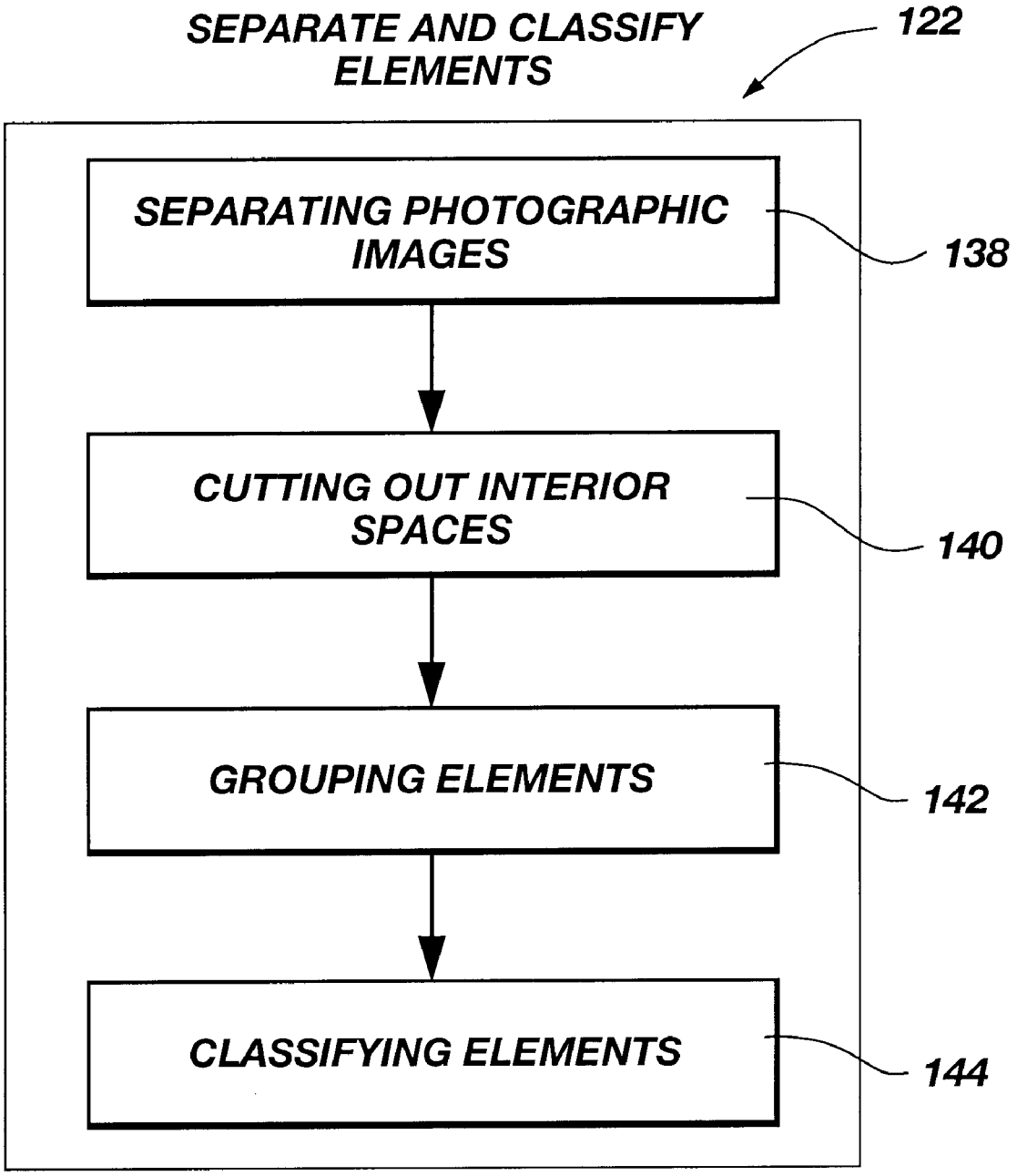
FIG. 15 is a flowchart of a method for element separation and classification of pattern in accordance with the invention.

The step after selecting elements 120 is separating and classifying elements 122. FIG. 15 shows a flowchart of the steps in separating and classifying elements 122, including separating elements 138, cutting out interior spaces 140, grouping elements 142, and classifying elements 144. Separating elements 138 includes cutting out the selected photographic image 11 from the entire photographic image, cutting along exterior boundaries 44 of the photographic image 11.

The next step, grouping the elements 142 includes dividing the photographic images into groups by color, shape and texture, putting like images together. The final step in separating and classifying elements 122 is classifying elements 144.

Each separated photographic image 11 is classified as groundcover 58, mid-size element 72 or large element 80, depending on the size of each image relative to the other images in the pattern 10. The classification of each photographic image depends on the selected environment.

Generally, common low growing plants or rocks would be groundcover 58. For example in one embodiment, the groundcover 58 is made up of photographic images 11 of small shrubs. In another embodiment, the groundcover 58 could be clumps of grass, rocks, or low growing herbs. Which photographic images are selected as groundcover 58 depends on the size and types of plants present in the selected environment.

Mid-size elements 72 may range from grasses to trees, depending on the selected environment. In the illustrated embodiment of a sagebrush environment, the mid-size elements 72 are small bushes. In an alternative embodiment of a conifer/aspen ecotone, the mid-size elements 72 may be photographic images 11 of aspen trees. The selection of mid-size elements 72 depends on the features in the landscape. For example, groundcover 58 in one embodiment may be a mid-size element 72 in another.

Large elements 80 may be photographic images 11 of tall grass clumps, herbs, bushes, trees, rocks or any other landscape feature that dominates the selected environment. In the illustrated environment, photographic images 11 of large sagebrush are the large elements 80 in the pattern. In another embodiment of a juniper/sage forest, the large elements 80 would be the image of juniper. The photographic images 11 selected as large elements 80 also depend on the other landscape features in the selected environment. Mid-size elements 72 in one embodiment may be large elements 80 in another embodiment. For example, in a pattern 10 representing a sagebrush/juniper environment, sagebrush may be the mid-size element 72. In a pattern 10 representing a sagebrush and small bush environment, the sagebrush images may be the large elements 80.

Figure 16:
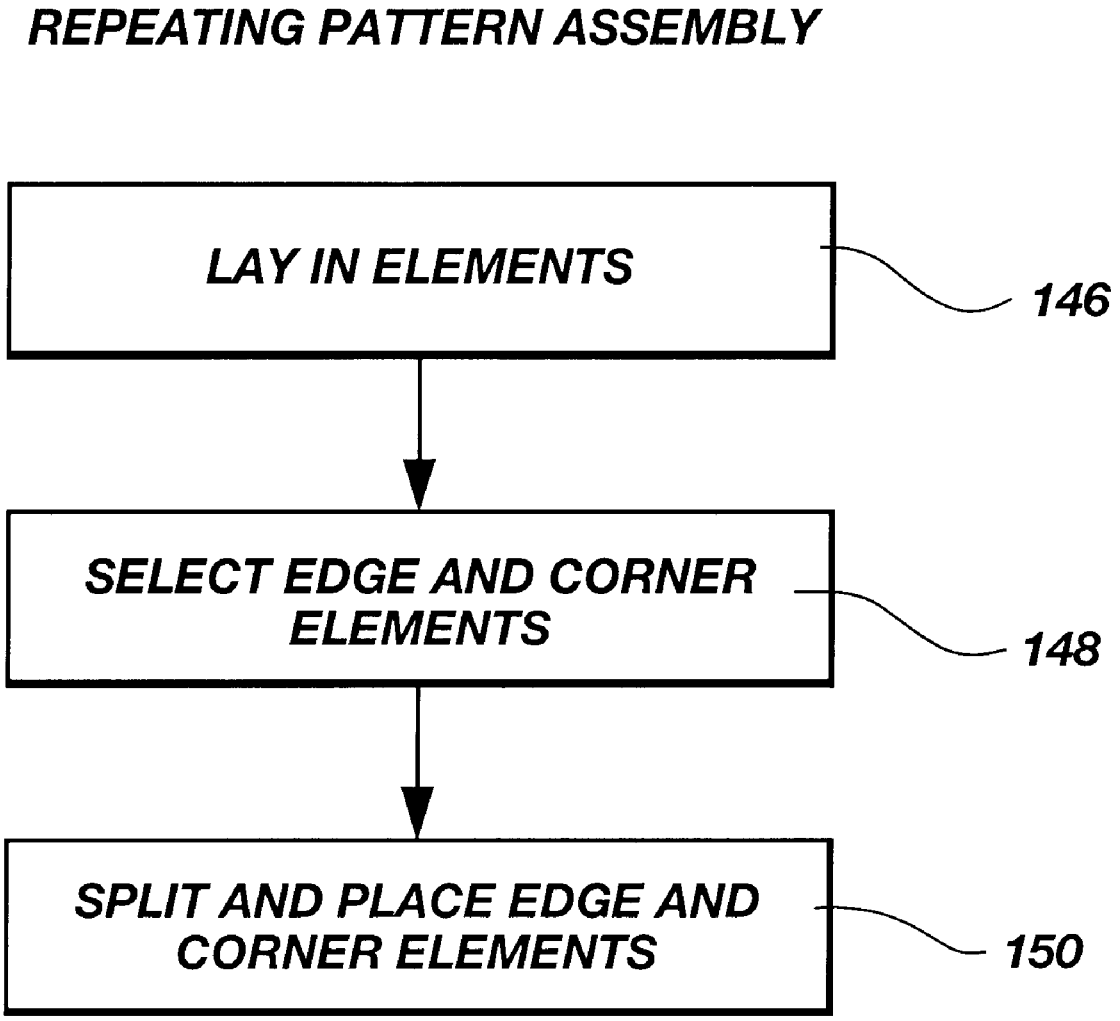
FIG. 16 is a flowchart of a method for pattern assembly.

FIG. 16 is a flowchart of the steps for pattern assembly 114, including laying elements 146, selecting edge and corner elements 148, and splitting and placing corner and edge elements 150.

Figure 17:
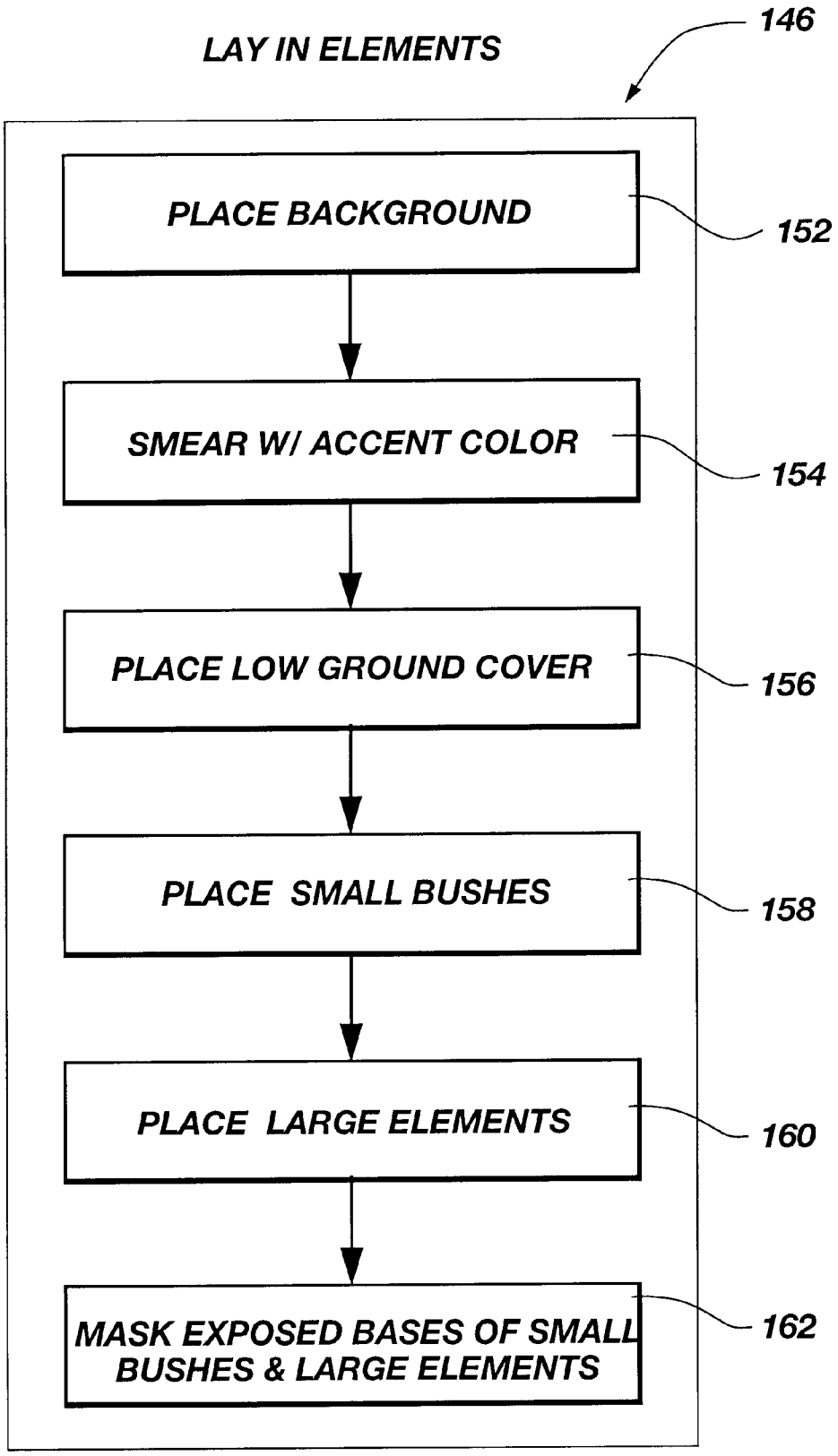
FIG. 17 is a flowchart of a method for element placement.
Figure 18:
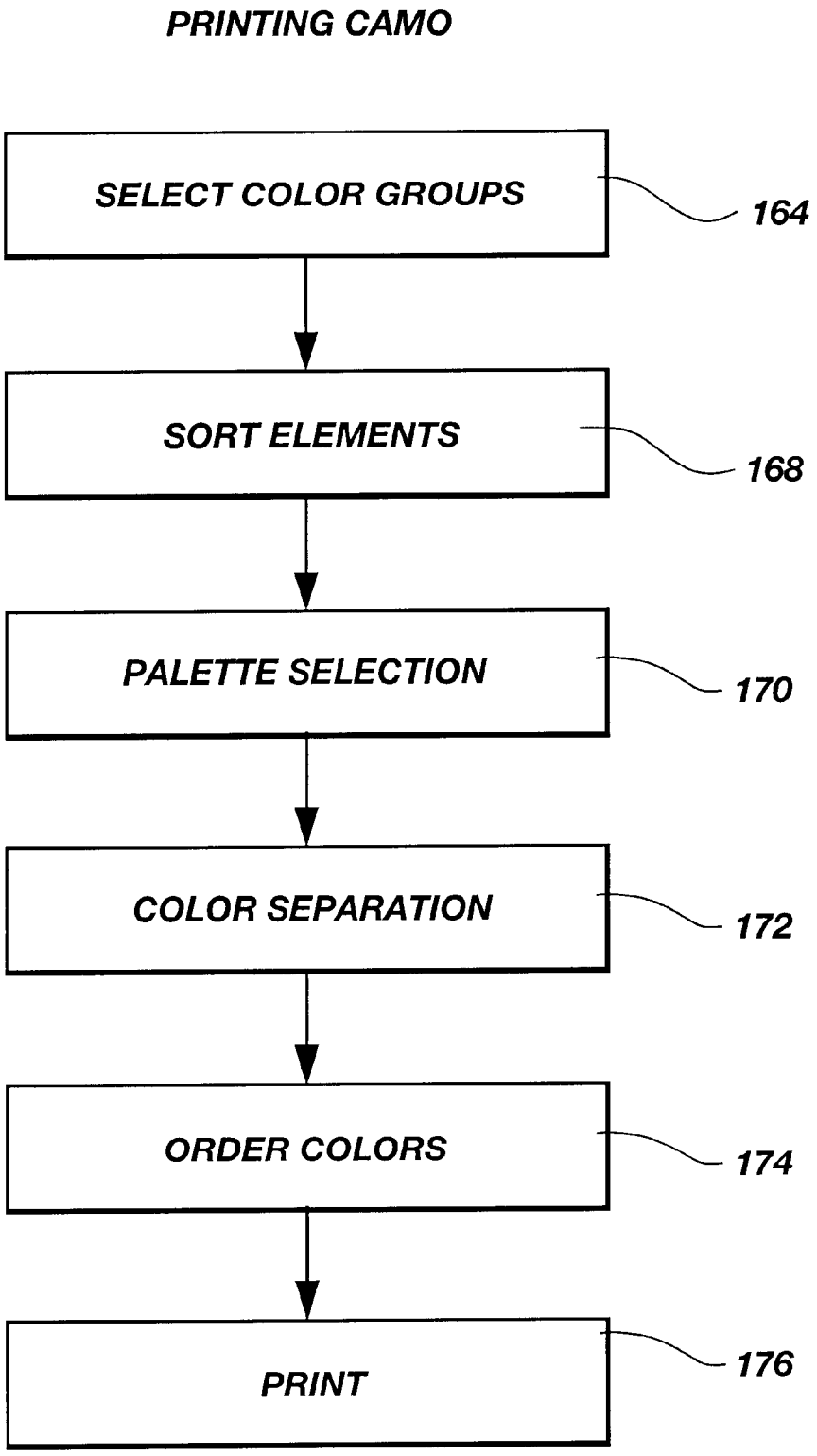
FIG. 18 is flowchart of a method for printing of a pattern in accordance with the invention.

As shown in FIG. 17, the steps of laying elements 146 are: placing background 152, smearing accent color 154, placing groundcover 156, placing mid size elements 158, placing large elements 160, masking bases of elements. The placing background step 152 includes laying the background 54 as the first layer of the pattern 10. Smearing accent color 154 includes reviewing selected environment, as captured in photographs, and placing the accent color 56 to create an appearance of shadow and texture that reflects the ground or background foliage of the selected environment.

In the illustrated pattern 10, placing groundcover 156 includes evenly distributing the groundcover 58 over the background 54, in a density that approximates the density of groundcover in the selected environment. Alternative embodiments may have unevenly distributed groundcover 58 to match the groundcover of the selected environment. In other embodiments, where the selected environment has no low growing plants or other groundcover, the pattern 10 lacks groundcover 58 altogether.

In the illustrated pattern, the next step, placing mid-size elements 158, includes distributing the mid-size elements 72 farther apart relative to the groundcover 58, with more space between each mid-size element 72 than between each groundcover 58. The spacing of the mid-size elements 72 matches the spacing of mid-size landscape features in the selected environment. The mid-size elements 72 are spaced close together relative to the groundcover 58 in patterns 10 where the selected environment has a higher density of mid-size landscape features than groundcover features.

Each mid-size element 72 obscures any overlapping portion of groundcover 58 that lies directly behind and above the mid-size element 72. Each groundcover 58 that lies below and directly in front of the base 74 of a mid-size element 72 obscures the overlapping portion of the mid-size element 72.

The next step of laying elements 146 is placing large elements 160. The large elements 80 are spaced to match the density and distribution of large landscape features in the selected environment. A large element 80 obscures any mid size elements 72 or groundcover 58 that overlap and lie above the base 82 of a large element 80. A large element 80 is obscured by any overlapping mid-size elements 72 or groundcover 58 with bases 74, 76 that lie below the base 82 of the large element 80.

The final step of laying elements 146 is masking exposed bases of mid size and large elements 72, 80 to continue creating synthetic perspective. Where the base 74 of a mid-size element 72 is exposed, a groundcover 58 is brought below and overlapping the base 74 of a mid size element 72. This step is repeated until the base 74 of the mid size element 72 is obscured to the point a base of a mid-size landscape feature would be hidden by surrounding vegetation in the selected environment. These same steps are followed to mask an exposed bases 82 of large elements 80, using either groundcover 58 or mid-size elements 72, matching the features that surround large landscape features in the selected environment.

In some selected environments, some or all of the bases 74, 82 of the large elements 80 and mid-size elements 72 may not require masking. For instance, in the case of a conifer forest as the selected environment, no other plants grow around the base of certain conifers. Where the bases of landscape features are exposed, the masking step is skipped.

The next step in pattern assembly 114 is selecting edge and corner elements 148. A number of edge elements 84 should be selected to ensure that all four edges of the pattern 10 are repeatable. In the illustrated embodiment, a range of distinct sizes of edge elements 84 have been selected. At least one corner element must be selected. In the illustrated embodiment, a large element 80 is selected to be a corner element 148. In alternative embodiments, the corner element 148 may be groundcover 58, background 54, mid-size element 72 or a large element.

Figure 9B:
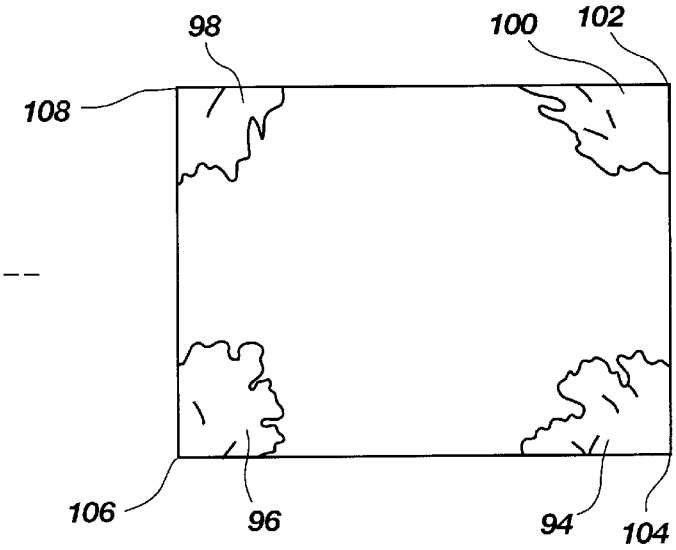
FIG. 9B is an illustration showing the position of a corner element in a pattern.

Splitting and placing edge and comer elements 150 includes splitting the edge elements 84 into two halves 88, 90 and the corner elements 92 into four quadrants 94, 96, 98, 100. One half 88 of the edge element 84 is placed at one edge 85 and the other half 90 is placed at the edge 86 opposite the first edge, creating a pattern 10 that repeats at the edge, as shown in FIG. 8B. The four quadrants 94, 96, 98, 100 of the comer are positioned in alignment with the four corners 102, 104, 106, 108 of the pattern 10. The positioning of the four quadrants 94, 96, 98, 100 creates a pattern 10 that repeats at the corners, as shown in FIG. 9B.

The step after laying elements 146 is printing the pattern 116. The step of printing the pattern 116 includes: selecting color groups 164, sorting elements portions 166, selecting palette 168, color separating 170, ordering colors 172, and printing 174. Selecting color groups 164 includes choosing the most frequent colors within the entire landscape.

The next step, sorting elements 166 includes determining which elements belong in each color group. A color group is a set of portions of the pattern 10 that share a similar coloring. For example, a portion of all the large elements 80 may share a similar coloring and be grouped together as a color group. Alternatively, every portion of the large elements 80 in the pattern 10 may be of distinct colors and be placed in unique color groups. Portions of background 58, mid-size elements 72, and large elements 80 may all share a similar color, and be placed in the same color group. For example the background 58, mid-size elements 72, and large elements 80 may all have a dark brown color on a stem portion of the photographic image. The stems would then make up a dark brown color group.

Selecting the palette 168 includes selecting a single color to represent each color group. For example, the most common color in the color group may be chosen to represent the entire group. Alternatively, all colors in the color group may be combined to form a composite color of the color group.

The next step, separating colors 170, includes isolating each color group of the pattern 10 from the other color groups in the pattern, creating a single color image for each color group.

Ordering colors 172 includes reviewing the pattern 10 in conjunction with the photographic images 11 of the selected environment and determining the order of dominance of the colors, the most dominant color being the color which appears to be in the foreground relative to other colors in the pattern 10. The single color images should be placed in order of least dominant color to the most dominant color.

Figure 19:
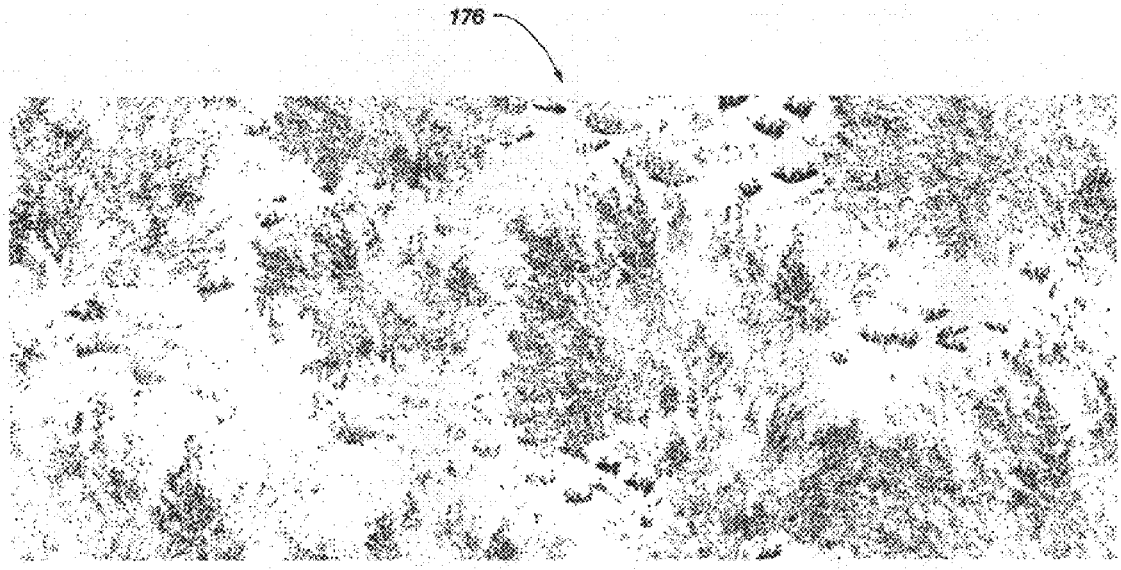
FIGS. 19–21 are illustrations of various color plates for a color separation process in accordance with te invention.
Figure 20:
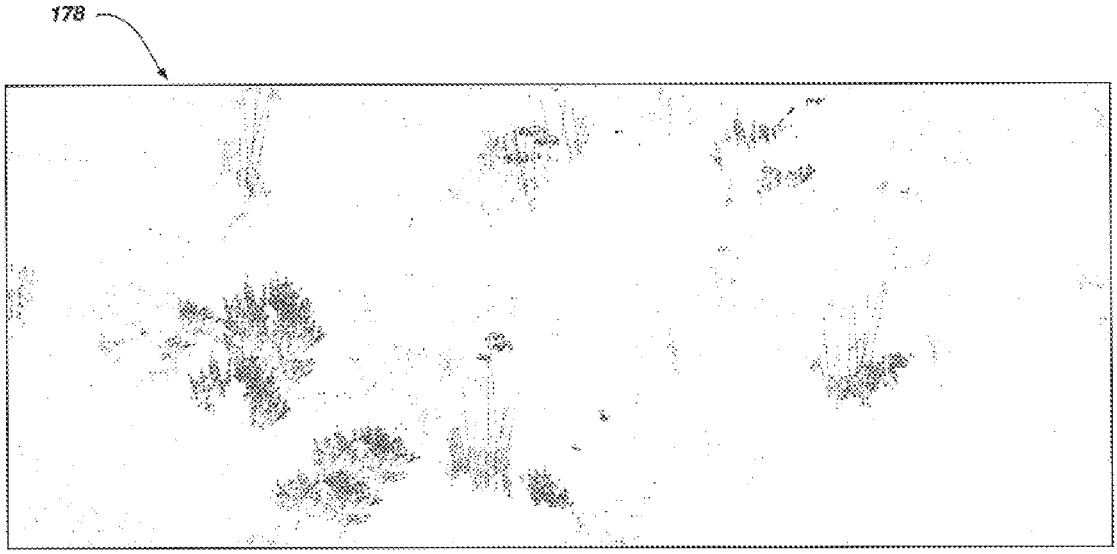
Figure 21:
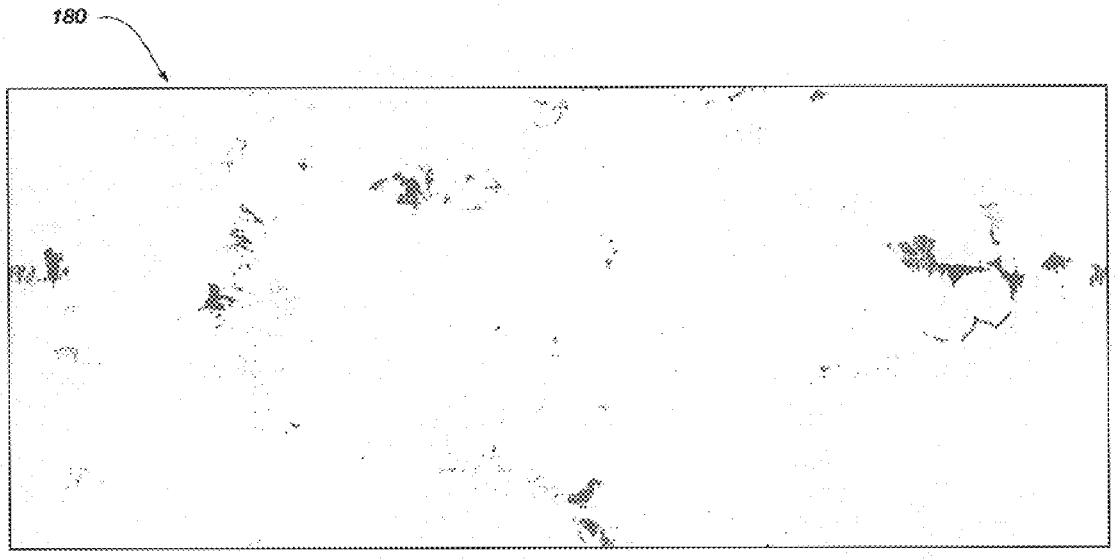

Printing the pattern 10 includes printing each singe color image on a substrate. The single color images are printed in order from least dominant color to the most dominant color. Printing may also include printing the pattern repeatedly in one or two dimensions. The substrate may be any substrate adapted for printing on fabric or the fabric itself FIGS. 19–21 show examples of single color images in black. In the illustrated embodiment FIG. 19 is a single color image 176, printed as the fifth layer on a substrate. FIGS. 20 and 21 are single color images 178, 180 and are printed as layers seven and ten, respectively, in the illustrated embodiment.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A camouflage comprising:

a pattern comprising an organization for pattern elements arranged in the pattern and an ecotone motif corresponding to a selected environment;

photographic images of discrete landscape features corresponding to ecotones representative of the selected environment;

the photographic images ordered in a synthetic perspective relationship;

the photographic images placed as pattern elements according to the organization and adapted for imprinting on a substrate; and wherein the organization includes photographic images ordered into classes by size, and ordered by class in the pattern from small to large.

2. The camouflage of claim 1, wherein the synthetic perspective comprises:

a reference image that is also a photographic image, the reference image lying in a reference plane;

a photographic image that lies in a plane behind the reference plane and is masked by a portion of the reference image that overlaps the photographic image; and another photographic image that lies in a plane in front of the reference plane and masks a portion of the reference image that overlaps that photographic image.

3. The camouflage of claim 2 wherein the reference image has a base, wherein the base is masked by a photographic image.

4. The camouflage of claim 1, wherein the photographic images have interior boundaries which define interior spaces, allowing background images to show through the interior spaces of foreground images.

5. The camouflage of claim 1, wherein the photographic images are selected to represent various sizes of discrete landscape features present in the selected environment.

6. The camouflage of claim 1, wherein the photographic images are selected to represent colors and textures corresponding to discrete landscape features.

7. The camouflage of claim 1, wherein one of the pattern elements is a background, with a color selected to match a dominant ground color of the selected environment.

8. The camouflage of claim 7, wherein the background is smeared with an accent color, selected to match a secondary ground color of the selected environment.

9. The camouflage of claim 8, wherein the pattern is organized with the background forming a first layer of the pattern, photographic images of low growing plants forming a second layer, photographic images of small shrubs forming a third layer, and photographic images of large bushes forming a fourth layer.

10. The camouflage of claim 9, wherein the pattern is further organized with photographic images of low growing plants substantially evenly distributed a comparatively smaller distance apart, and photographic images of small bushes overlaid thereby and distributed a comparatively larger distance apart.

11. The camouflage of claim 1, wherein the pattern includes corner elements and edge elements rendering the pattern a repeating image.

12. The camouflage of claim 1, further comprising a substrate, and wherein the pattern is seamlessly repeated across a surface of the substrate.

13. The camouflage of claim 12, wherein the pattern is seamlessly repeated in two dimensions.

14. The camouflage of claim 1, further comprising a substrate, and wherein the pattern is printed on a substrate.

15. The camouflage of claim 14, wherein the substrate comprises a material formed to be comparatively flexible in a transverse direction and comparatively inflexible orthogonally to the transverse direction.

16. An apparatus comprising:

a substrate comprising a material having an aspect ratio of thickness to area corresponding to a textile fabric, and having a presentation surface corresponding to the area thereof;

a surface pattern applied to the substrate and comprising:

pattern elements with an ecotone motif corresponding to a selected environment;

photographic images of distinct landscape features selected from images of scenes of ecotones representative of the selected environment; and the photographic images ordered in a synthetic perspective relationship; and wherein one of the pattern elements is a background, with a color selected to match a dominant ground color of the selected environment.

17. The apparatus of claim 16, wherein the synthetic perspective comprises:

a reference image that is also a photographic image, the reference image having a base and lying in a reference plane;

a photographic image that lies in a plane behind the reference plane and is masked by a portion of the reference image that overlaps the photographic image; and another photographic image that lies in a plane in front of the reference plane and masks a portion of the reference image that overlaps that photographic image.

18. The apparatus of claim 17, wherein the reference image has a base and the base is masked by a photographic image.

19. The apparatus of claim 18, wherein the photographic images have interior boundaries which define interior spaces and wherein the interior spaces reveal background photographic images to show through the interior spaces of foreground photographic images.

20. The apparatus of claim 19, wherein the photographic images are selected to represent distinct sizes of discrete landscape features.

21. The apparatus of claim 20, wherein the photographic images are ordered into classes by size, and ordered by class in the pattern in the order of small to large.

22. The apparatus of claim 21, wherein the photographic images are selected to represent the distinct colors and textures of discrete landscape features.

23. The apparatus of claim 16, wherein the background is smeared with an accent color, selected to match a secondary ground color of the selected environment.

24. The apparatus of claim 23, wherein the pattern is organized such that the background forms a bottom layer of the pattern, photographic images of low growing plants form a second layer, photographic images of small shrubs form a third layer, and photographic images of large bushes form a fourth layer.

25. The apparatus of claim 24, wherein the pattern is further organized with nearly evenly scattered photographic images of low growing plants, sparsely overlaid with photographic images of small bushes.

26. The apparatus of claim 25, wherein the pattern includes corner elements and edge elements positioned to render the pattern repeatable.

27. The apparatus of claim 26, wherein the pattern is seamlessly repeated across a surface.

28. The apparatus of claim 27, wherein the pattern is seamlessly repeated in two dimensions.

29. A camouflage comprising:

a pattern comprising an organization for pattern elements arranged in the pattern and an ecotone motif corresponding to a selected environment;

photographic images of discrete landscape features corresponding to ecotones representative of the selected environment;

the photographic images ordered in a synthetic perspective relationship;

the photographic images placed as pattern elements according to the organization and adapted for imprinting on a substrate; and wherein the pattern includes corner elements and edge elements positioned to render the pattern repeatable.

30. The camouflage of claim 29, wherein the synthetic perspective comprises:

a reference image that is also a photographic image, the reference image lying in a reference plane;

a photographic image that lies in a plane behind the reference plane and is masked by a portion of the reference image that overlaps the photographic image; and another photographic image that lies in a plane in front of the reference plane and masks a portion of the reference image that overlaps that photographic image.

31. The camouflage of claim 30 wherein the reference image has a base, wherein the base is masked by a photographic image.

32. The camouflage of claim 29, wherein the photographic images have interior boundaries which define interior spaces, allowing background images to show through the interior spaces of foreground images.

33. The camouflage of claim 29, wherein the photographic images are selected to represent various sizes of discrete landscape features present in the selected environment.

34. The camouflage of claim 29, wherein the organization includes photographic images ordered into classes by size, and ordered by class in the pattern from small to large.

35. The camouflage of claim 29, wherein the photographic images are selected to represent colors and textures corresponding to discrete landscape features.

36. The camouflage of claim 29, wherein one of the pattern elements is a background, with a color selected to match a dominant ground color of the selected environment.

37. The camouflage of claim 36, wherein the background is smeared with an accent color, selected to match a secondary ground color of the selected environment.

38. The camouflage of claim 37, wherein the pattern is organized with the background forming a first layer of the pattern, photographic images of low growing plants forming a second layer, photographic images of small shrubs forming a third layer, and photographic images of large bushes forming a fourth layer.

39. The camouflage of claim 38, wherein the pattern is further organized with photographic images of low growing plants substantially evenly distributed a comparatively smaller distance apart, and photographic images of small bushes overlaid thereby and distributed a comparatively larger distance apart.

40. The camouflage of claim 29, further comprising a substrate, and wherein the pattern is seamlessly repeated across a surface of the substrate.

41. The camouflage of claim 40, wherein the pattern is seamlessly repeated in two dimensions.

42. The camouflage of claim 29, further comprising a substrate, and wherein the pattern is printed on the substrate.

43. The camouflage of claim 42, wherein the substrate comprises a material formed to be comparatively flexible in a transverse direction and comparatively inflexible orthogonally to the transverse direction.

* * * * *

US006342290C1

(12) EX PARTE REEXAMINATION CERTIFICATE (8438th)

United States Patent

Conk

(10) Number: US 6,342,290 C1

(45) Certificate Issued: Aug. 2, 2011

(54) CAMOUFLAGE PATTERN METHOD AND APPARATUS

(76) Inventor: Nathan T. Conk, Elko, NV (US)

Reexamination Request:
No. 90/009,816, Oct. 18, 2010

Reexamination Certificate for:

| | |
|---|---|
| Patent No.: | **6,342,290** |
| Issued: | **Jan. 29, 2002** |
| Appl. No.: | **09/436,280** |
| Filed: | **Nov. 8, 1999** |

(51) Int. Cl.

| | |
|---|---|
| ***B44F 9/00*** | (2006.01) |
| ***B44F 1/00*** | (2006.01) |
| ***B44F 7/00*** | (2006.01) |
| ***B44F 1/10*** | (2006.01) |

(52) U.S. Cl. ..... 428/195.1; 428/15; 428/17; 428/919; 2/900

(58) Field of Classification Search ..... None
See application file for complete search history.

(56) References Cited

U.S. PATENT DOCUMENTS

| | | | |
|---|---|---|---|
| 5,727,253 | A | 3/1998 | Wilkinson |
| 5,753,323 | A | 5/1998 | Andrus |
| 5,972,479 | A | 10/1999 | Lehman |
| 6,061,828 | A | 5/2000 | Josephs |
| 6,342,290 | B1 | 1/2002 | Conk |

*Primary Examiner*—Stephen Stein

(57) ABSTRACT

A pattern for camouflage and a method for making the pattern. Rely on photographic images arranged in a synthetic perspective relationship, appearing to extend toward the horizon. The photographic images are images of landscape features in a selected environment. The pattern blends in with landscape features both in proximity to and distant from the camouflage pattern. In one embodiment, the pattern is adapted to be seamlessly repeatable across a surface. In one or two dimensions the method for making the camouflage includes taking photographs and selecting photographic images that represent the landscape features in the selected environment. The method also includes separating those images and arranging them into a repeating pattern. Photographic images are arranged in synthetic perspective which includes obscuring background images with foreground images in a manner that simulates the perspective in the selected environment.

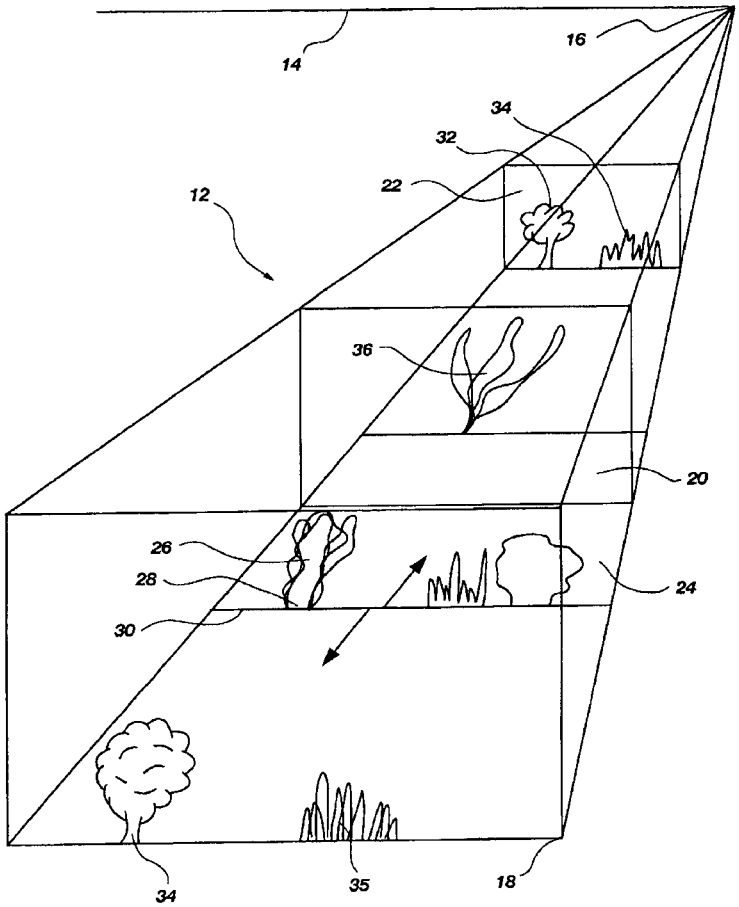

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-43 are cancelled.

* * * * *